US005733026A

United States Patent [19]

Munachen

[11] Patent Number: 5,733,026

[45] Date of Patent: Mar. 31, 1998

[54] DRAWER SLIDE

[75] Inventor: Richard Munachen, Lilley, Great Britain

[73] Assignee: Metsec PLC, Oldbury, England

[21] Appl. No.: 682,614

[22] PCT Filed: Jan. 24, 1995

[86] PCT No.: PCT/GB95/00133

§ 371 Date: Sep. 19, 1996

§ 102(e) Date: Sep. 19, 1996

[87] PCT Pub. No.: WO95/19724

PCT Pub. Date: Jul. 27, 1995

[30] Foreign Application Priority Data

Jan. 25, 1994 [GB] United Kingdom ..... 9401310

[51] Int. Cl.[6] ..... A47B 88/00

[52] U.S. Cl. ..... 312/334.12; 312/330.1; 312/334.19; 312/334.44; 384/19

[58] Field of Search ..... 312/334.7, 334.9, 312/334.12, 334.11, 334.16, 334.17, 334.18, 334.19, 334.2, 334.21, 334.44, 334.45, 334.46; 384/18, 19, 20

[56] References Cited

U.S. PATENT DOCUMENTS

| | | | |
|---|---|---|---|
| 883,069 | 3/1908 | Yawman | 312/334.12 |
| 1,109,812 | 9/1914 | Yawman | 312/334.12 |
| 3,923,347 | 12/1975 | Dean | 312/334.46 X |
| 4,121,876 | 10/1978 | Ratti | 384/19 |
| 4,295,688 | 10/1981 | Blasnik | 384/19 |
| 4,370,007 | 1/1983 | Fler | 312/334.11 |
| 4,659,237 | 4/1987 | Rapp | 384/19 |
| 4,747,704 | 5/1988 | Nelson | 384/19 |
| 5,090,820 | 2/1992 | Lautenschlager | 384/19 |
| 5,302,030 | 4/1994 | Buie et al. | 312/334.19 X |
| 5,395,169 | 3/1995 | Rock et al. | 384/19 |

FOREIGN PATENT DOCUMENTS

| | | | |
|---|---|---|---|
| 548474 | 1/1923 | France | 312/334.11 |
| 1172817 | 6/1964 | Germany . | |
| 2414151 | 10/1975 | Germany | 312/334.12 |
| 2518647 | 12/1976 | Germany | 312/334.18 |
| 259081 | 6/1949 | Switzerland . | |
| 543259 | 8/1972 | Switzerland . | |
| 2130472 | 6/1984 | United Kingdom | 312/334.12 |

*Primary Examiner*—Peter M. Cuomo
*Assistant Examiner*—Hanh V. Tran
*Attorney, Agent, or Firm*—Jacobson, Price, Holman & Stern, PLLC

[57] ABSTRACT

A drawer slide formed by cold rolling metal strip and shaped, in cross section, to define first mutually presented tracks for receiving and cooperating with a first set of rollers carried, in use, by a drawer, second mutually presented tracks for receiving and cooperating with rollers carried in use by the drawer receiving cabinet, a first web portion integrally interconnecting the first tracks, a second web portion integrally interconnecting the second tracks, an integral stop closing both ends respectively of a first channel defined by one of the first and second webs and its respective tracks, a cut-out adjacent one end of the outer track of the first channel to facilitate insertion of the respective rollers into the first channel, an integral stop closing the end of a second channel by the other of the first and second webs and the respective tracks, remote from the end of the slide having the cut-out, and an access aperture in the web portion of the second channel providing in use, access through the web portion to a device for securing the respective rollers to the drawer or to the cabinet carcass.

26 Claims, 7 Drawing Sheets

DRAWER SLIDE

Figure 1:
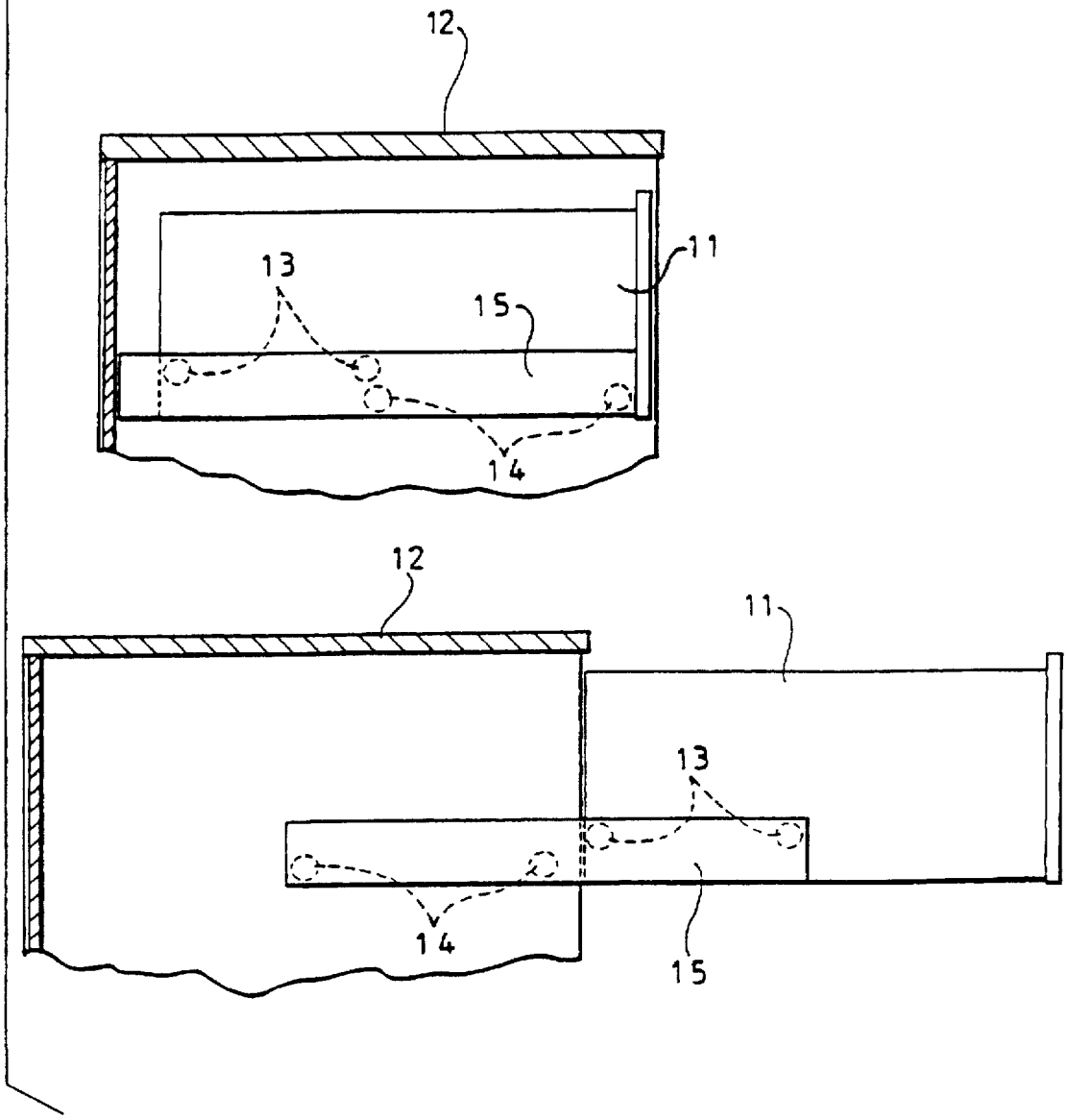

This invention relates to a drawer slide, a drawer slide assembly, and furniture utilizing such a drawer slide assembly, the term furniture being used herein to include items such as filing cabinets, and office furniture together with domestic furniture such as bedroom and kitchen drawer units.

It should be noted that the term "drawer slide" as used herein is a term known in the furniture art, and sometimes substituted by the term "drawer runner".

British Patent 1046638, and British Patent 2130472 (in the name of the inventor in relation to the present application) both disclose arrangements wherein a single drawer slide, at each side of a drawer, cooperates with rollers carried by the drawer and the carcass of the cabinet housing the drawer, slidably to support the drawer within the cabinet.

It is an object of the present invention to provide a drawer slide which can be manufactured by cold rolling of mild steel strip and which can be readily assembled in a situation in which both the drawer and the drawer cabinet nave been preassembled. The arrangement illustrated in British Patent 1046638 is unsuitable for manufacture by cold rolling of mild steel strip, and has several inherent disadvantages arising from the need to facilitate assembly to preconstructed drawers and cabinets. For example, the drawer rollers are secured to the drawer structure by screws passing completely through the drawer structure and so having their heads exposed within the drawer space, and the end stops of the runner are separately formed, detachable components. By comparison, the construction disclosed in British Patent 2130472 does lend itself to manufacture by cold rolling of mild steel strip, but the disclosure is of a drawer slide arrangement which can only be assembled prior to completion of the construction of the carcass of the cabinet housing the drawer.

It is one object of the present invention to provide an improvement over the drawer slide arrangement illustrated in British Patent 2130472 in which assembly to a preconstructed drawer and cabinet is facilitated.

In accordance with the present invention there is provided a drawer slide formed by cold rolling metal strip and shaped, in cross-section to define first mutually presented tracks for receiving and cooperating with a first set of rollers carried, in use, by a drawer, second mutually presented tracks for receiving and cooperating with rollers carried in use by the drawer receiving cabinet, a first web portion integrally interconnecting the first tracks, a second web portion integrally interconnecting the second tracks integral stop means closing both ends respectively of a first channel defined by one of the first and second weds and its respective tracks, a cut-out provided in the outer track of the first channel to facilitate insertion of the respective rollers into said first channel, integral stop means closing an end of a second channel defined by the other of said first and second webs and the respective tracks, and an access aperture in the web of said second channel providing, in use, access through the web to means for securing the respective rollers to the drawer or to the cabinet carcass.

The cut-out is preferably provided adjacent an end of the drawer slide, the integral stop means of the second channel being provided at the end thereof remote from the cut-out. Buffer means is preferably provided associated with the integral stop means adjacent the cut-out.

The buffer means associated with the stop means adjacent the cut-out preferably comprises a shock absorbent resilient member arranged to partially close the cut-out, in use, to restrict removal of the roller(s) from the first channel.

Alternatively, the cut-out may be spaced from an end of the slide.

Preferably, the drawer slide further comprises buffer means associated with at least one of the integral stop means of the first and second channels.

Preferably, each of the first and second tracks is of part circular cross-section.

Alternatively, each of the first and second tracks may be of generally 'V'-shaped cross-section or substantially flat.

Where the first and second tracks are substantially flat, at least one of the first and second tracks preferably forms part of a respective channel-shaped portion of the drawer slide.

The lower most one of the tracks of the drawer slide, in use, is preferably provided with an integral generally horizontally extending strengthening portion which may be provided between the said track and the respective web portion, or alternatively could be provided at the edge of the said track remote from the respective web portion, the free edge of the strengthening portion engaging the web portion.

Preferably, the drawer slide further comprises reinforcement means for reinforcing the integral stop means.

The invention further resides in a drawer slide assembly comprising a drawer slide of the type defined hereinbefore, and rollers arranged to be received in and to cooperate with the first and second tracks, wherein each roller comprises a spindle upon which a roller body is rotatably mounted.

At least one of the spindles preferably comprises a member arranged to receive the roller body, a spacer element, and elongate attachment means.

The member and the spacer element may be integral with one another, and the attachment means may be integral with the member, or may extend within a bore provided in the member.

The attachment means may comprise a screw-threaded member arranged to be mounted upon one of the drawer and cabinet, in use. The screw-threaded member may be arranged to engage a socket mounted on the drawer or cabinet.

The screw-threaded member is preferably provided with means for receiving a tool to aid rotation thereof.

Alternatively, the attachment means may include a region intended to be deformed to prevent removal of the roller body from one of the drawer and cabinet, in use.

The drawer slide assembly may further comprise a bracket arranged to be mounted upon at least one of the drawer and cabinet, in use, at least one roller being arranged to be mounted upon the bracket.

A cover may further be provided restricting access to the drawer slide and rollers.

The drawer slide assembly may further comprise additional stop means for restricting movement of the drawer slide with respect to the drawer and/or cabinet, in use.

The invention further resides in an article of furniture comprising a cabinet and a drawer, the drawer being mounted to the cabinet by means of a drawer slide assembly of the type defined hereinbefore.

Figure 2:
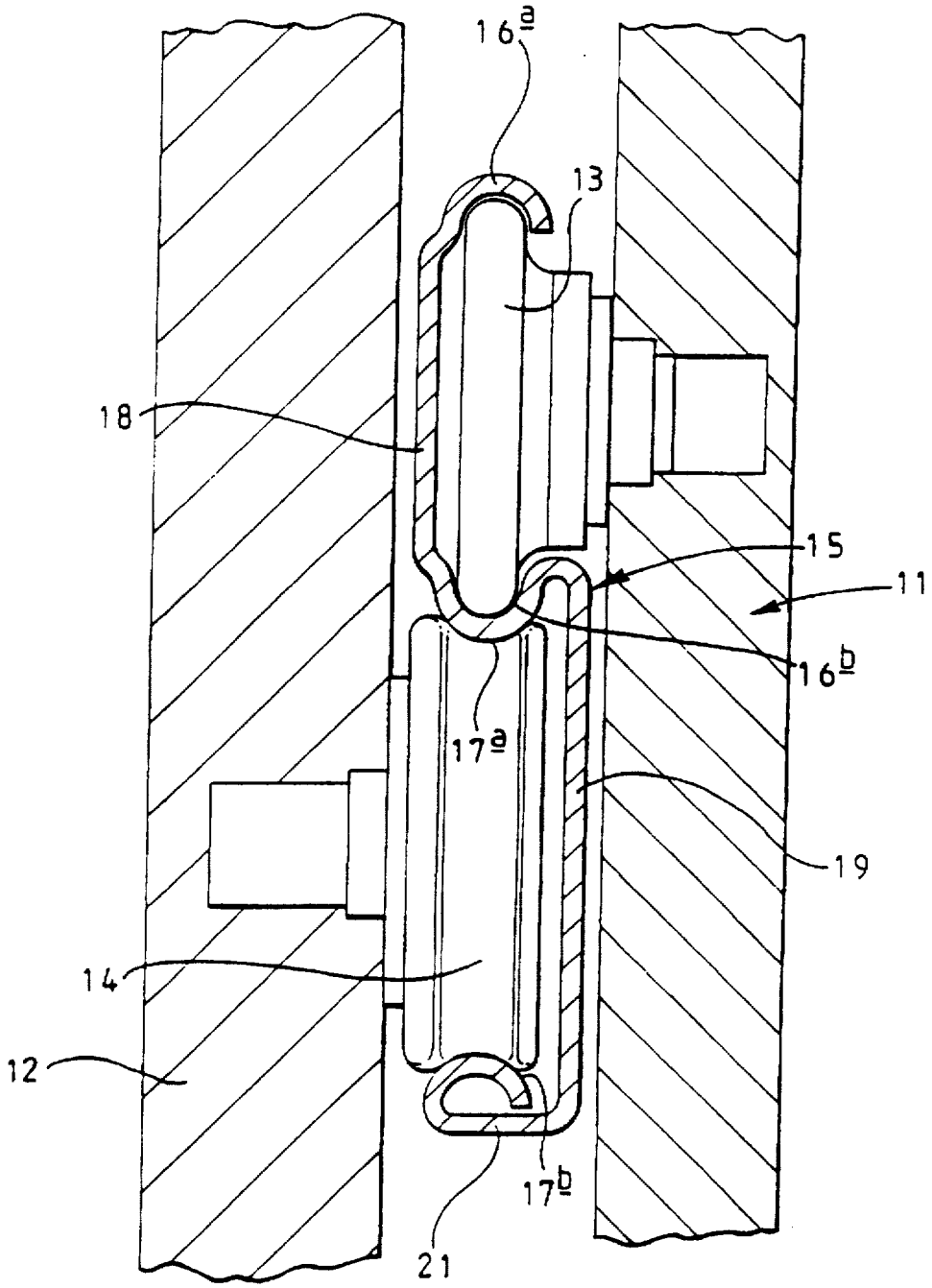
Figure 3A:
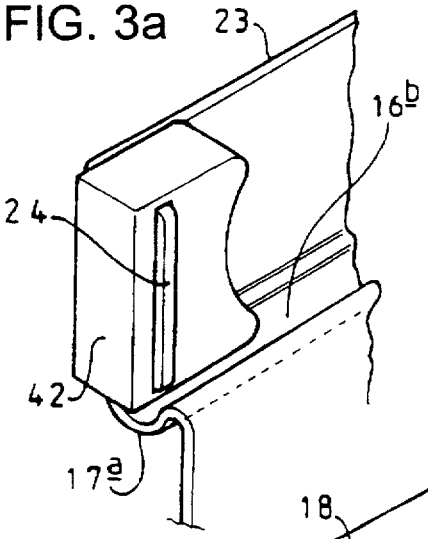
Figure 3:
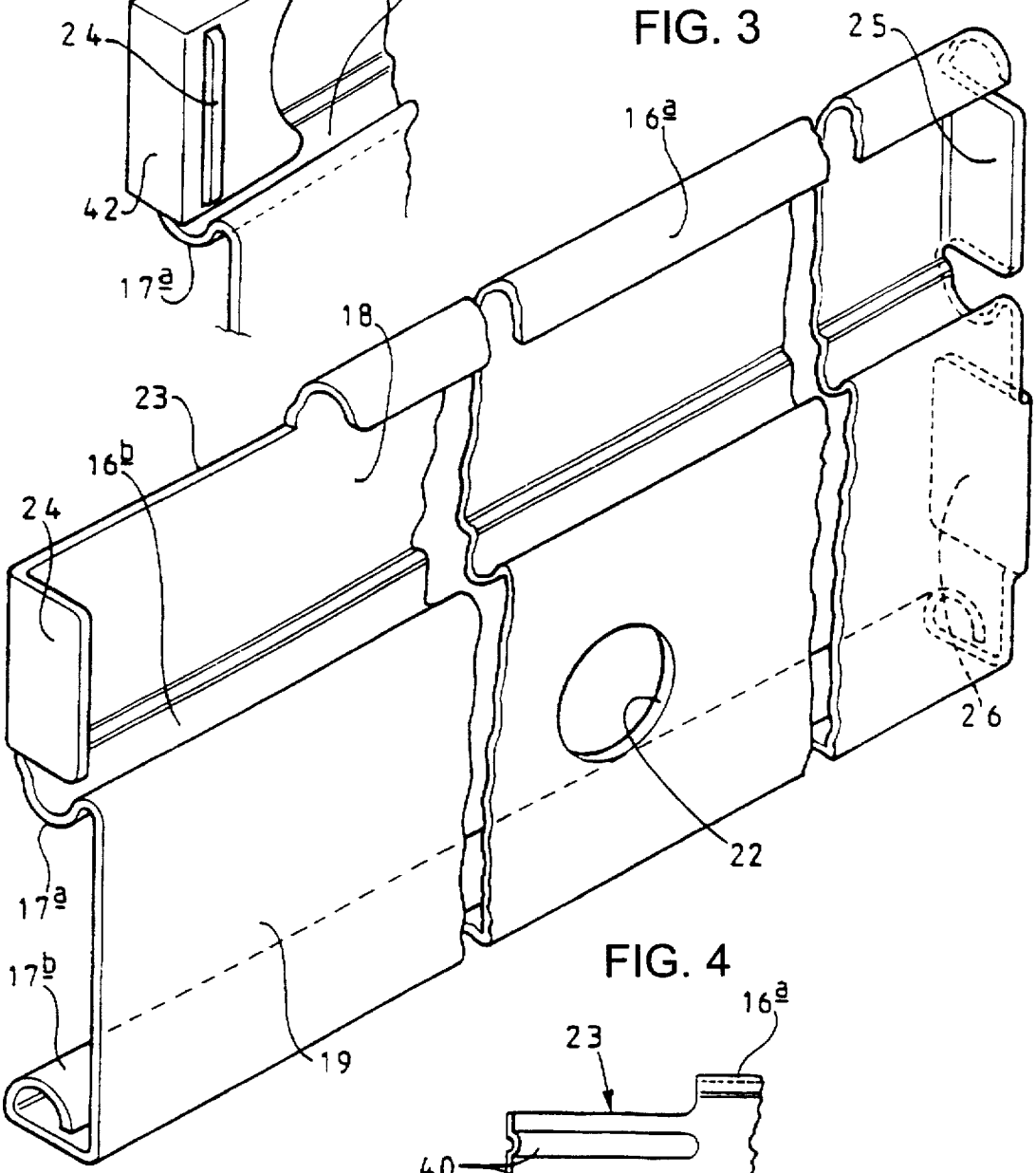
Figure 4:
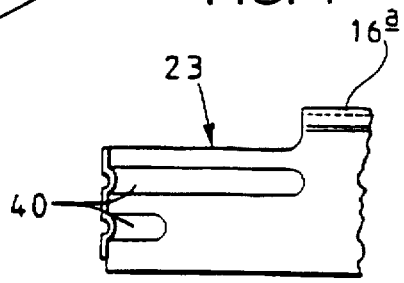
Figure 5:
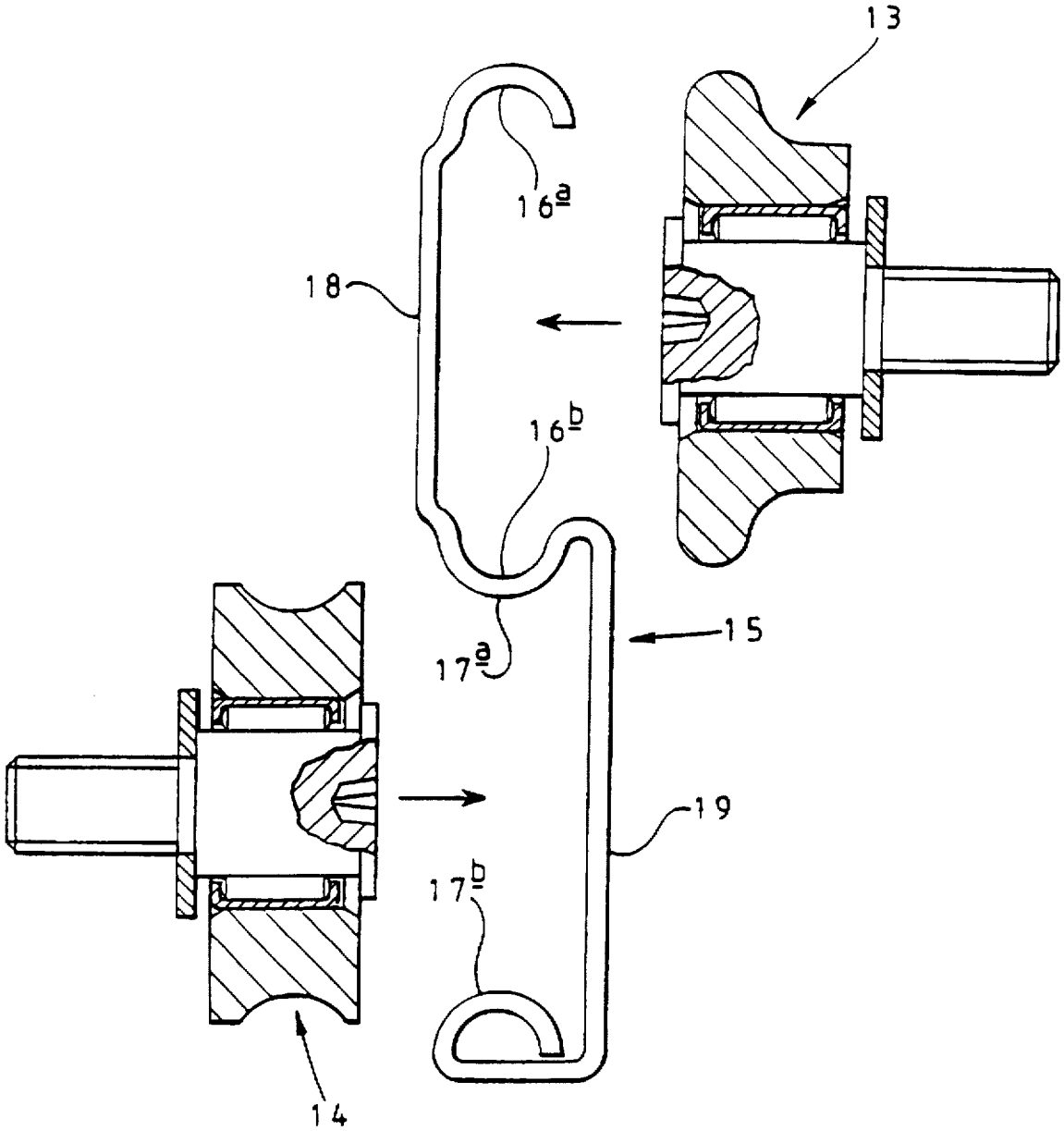
Figure 8:
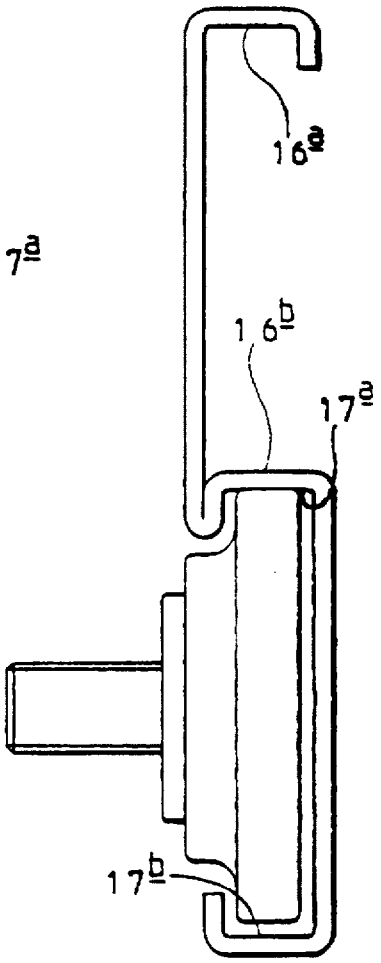
Figure 9:
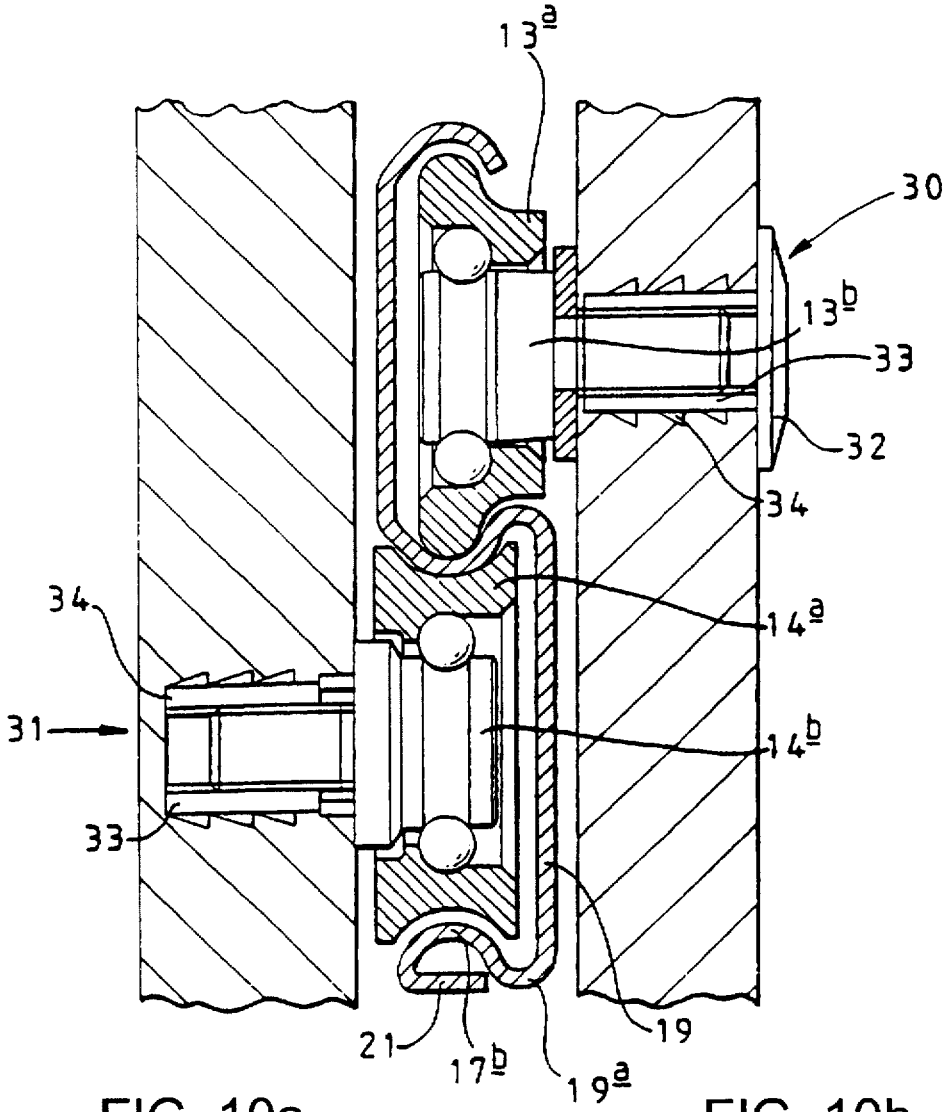
Figure 10A:
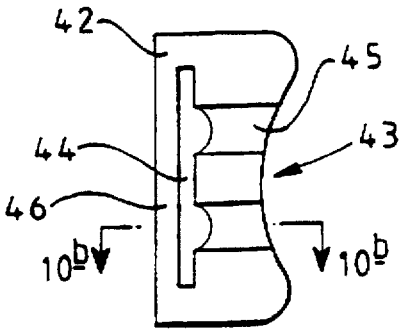
Figure 10B:
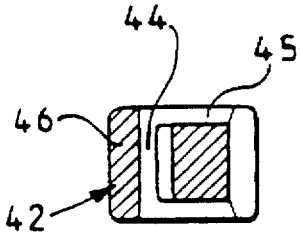
Figure 11:
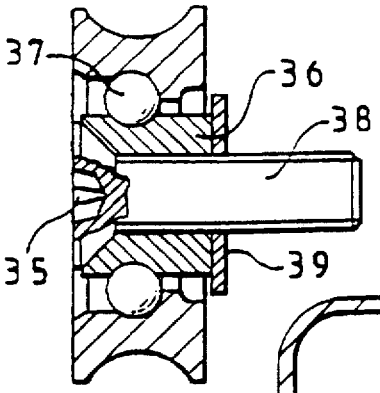
Figure 11A:
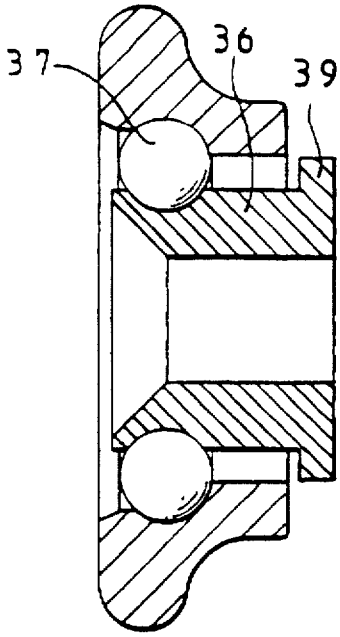
Figure 12:
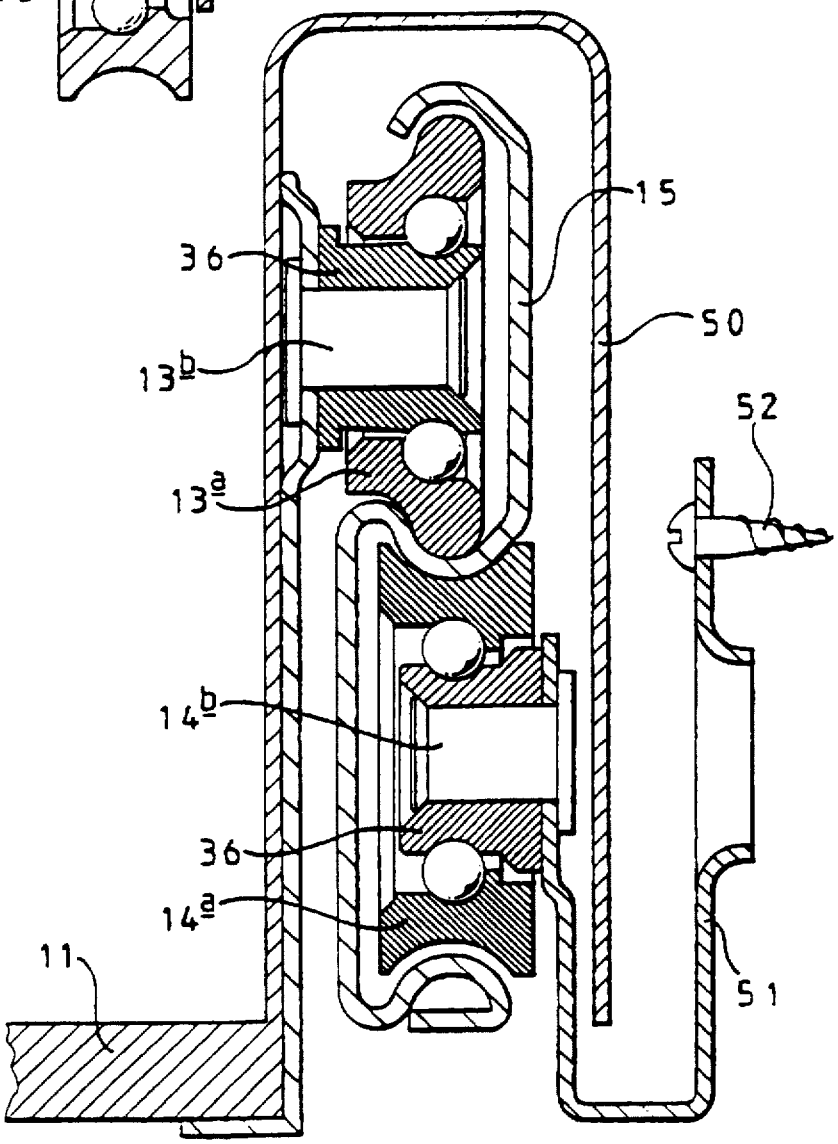

Examples of the present invention are illustrated in the accompanying drawings, wherein:

FIG. 1 is a diagrammatic side elevational view, in section, of a drawer cabinet showing, in the upper part of the view, the drawer closed, and in the lower part of the view the drawer open, FIG. 2 is a diagrammatic cross-sectional view of a drawer and drawer slide assembly in accordance with the first example of the present invention, FIG. 3 is a diagrammatic perspective view of the drawer slide illustrated in FIG. 2, FIG. 3*a* is a view of pan of FIG. 3 with a buffer in position, FIG. 4 is a diagrammatic view of a variation to the drawer slide illustrated in FIG. 3, FIG. 5 is a laterally exploded view similar to FIG. 2, but illustrating more detail of alternative roller constructions, FIGS. 6, 7, 8 and 9 are views similar to FIG. 5 but illustrating second, third, fourth and fifth alternative slide and roller configurations, FIGS. 10*a* and 10*b* are side and cross-sectional views respectively, of a buffer suitable for use in any one of the embodiments of FIGS. 1 to 9, FIG. 11 is a cross-sectional view of a roller suitable for use or adaptable for use in any one of the embodiments of FIGS. 1 to 10, FIG. 11*a* is a view similar to FIG. 11 of an alternative roller construction, and FIG. 12 is a cross-sectional view of the slide and roller configuration of FIG. 11*a* in use with a plastics or steel drawer provided with a skirt.

Referring first to FIG. 1 of the drawings it can seen that the drawer structure 11 is slidably supported within a cabinet carcass 12 by means of rollers 13, 14 carried by me drawer and the cabinet respectively, the rollers cooperating with a drawer slide 15. There is a similar drawer slide and roller arrangement at each side of the drawer, and it can be seen that a pair of spaced rollers 13 is carried by the side wall of the drawer 11 aligned horizontally above a pair of spaced rollers 14 carried by the side wall of the cabinet carcass. The rollers 13 of the drawer are positioned at the rear half of the drawer, and the rollers 14 of the cabinet are positioned at the front half of the cabinet. The drawer slide 15, which will be described in more detail hereinafter, is of a length determined by the length relationship of the drawer and the cabinet, and in an arrangement as shown in FIG. 1 where the drawer is only slightly shorter than the depth of the cabinet then the drawer slide 15 is similar in length to the drawer. The relationship between the rollers 13, 14 and the slide 15 will be described in more detail later, but it can be seen that the drawer 11 is supported by the cabinet through the intermediary of the slide 15 throughout the whole of its travel between its fully closed and its fully open position, the length of the slide and the spacing of the rollers determining the length of the drawer travel.

If rather than positioning the rollers 13, 14 so that the drawer slide 15 extends horizontally, the rollers 13, 14 are positioned so that the drawer slide 15 is inclined at an angle of, for example 1½° to 4° to the horizontal, with the end of the slide 15 adjacent the drawer front higher than the other end thereof, the drawer 11 will tend to close itself.

Referring now to FIGS. 2 and 3 it can be seen that the rollers 13 have a peripheral running surface or tread which is convex in transverse cross-section whereas the rollers 14 have a tread of concave cross-section. The tracks of the slide 15 are shaped to coact with the treads of the rollers, the slide 15 being formed by a cold rolling operation from mild steel strip.

In cross-section the slide 15 is basically an S-shape the upper curve of the S defining a pair of parallel, mutually presented upper tracks 16 cooperating with the rollers 13, and the lower curve of the S defining a pair of spaced mutually presented, lower tracks 17 cooperating with the rollers 14. More specifically the edge of the slide 15 which will be uppermost in use is, in cross-section, shaded to a part circular form to define the top track 16*a* of the upper tracks 16. The curve of the track 16*a* is arranged with its concave face presented vertically downwardly, and an integral vertically extending web 18 lies between the rollers 13 and the side wall of the cabinet in use and integrally unites the top track 16*a* with an intermediate region of the slide 15, which defines the lowermost track 16*b* of the upper tracks 16 and the top track 17*a* of the lower tracks 17. The intermediate region defines a mirror image of the track 16*a* so that the concave face of the track 16*b* is presented vertically upwardly, and the convex outer face of the strip at that point defines the track 17*a*. At the termination of the tracks 16*b* and 17*a* the strip is bent through approximately 180° to define a second web 19. The web 19 extends vertically downwardly in use between the rollers 14 and the side wall of the drawer 11 and at its lower edge the strip is bent at right angles to form a flange 21 the free edge of which is bent inwardly over the flange to form a convex rib defining the bottom track 17*b* of the lower tracks 17.

Theoretically the cross-sectional shade of the tracks 16 will correspond exactly to the cross-sectional shape of the treads of the rollers 13 but in practice the treads of the rollers 13 will preferably be slightly smaller than the tracks so as to allow a running clearance, the relationship between the treads of the rollers 14 and the tracks 17 being similar.

Closer examination of FIG. 3 illustrates that adjacent its mid-point, the web 19 is formed with a large circular aperture 22; one end region of the cured portion defining the track 16*a* is removed defining a cut-out 23; both ends of the channel defined by the tracks 16 and the wed 18 are closed by integral, upturned flanges 24, 25; and the end of the channel defined by the tracks 17 and the web 19, remote from the cut-out 23 is closed by an integral upstanding flange 26, the opposite end of the channel being open.

It will be understood that the drawer slide at the opposite side of the drawer 11 is a mirror image of the drawer slide described above.

Each roller 13, 14 may be defined by moulded synthetic resin, or a cast metal, body rotatably mounted on a corresponding spindle the spindle protruding from the roller for attachment to the drawer or cabinet. The nature of the bearing between the roller and its spindle will be determined to some extent by the loading which the assembly is to carry in use, and plain bearings may be used in some circumstances. However, often it will be preferred to use a ball bearing, and in some instances needle roller bearings, of the kind illustrated in FIG. 5, may be utilized. The manner in which the spindles are secured to the drawer and the cabinet respectively will also be determined by the application, and for example where the cabinet and drawer construction is wood or chipboard then the spindles may be received in plastics bushes or sockets anchored in corresponding bores in the drawer and cabinet walls. FIG. 9 shows two different types of plastics bush or socket 30, 31 provided in a wood or chipboard cabinet and drawer arrangement. In the upper part of the drawing, the plastics socket 30 is arranged to be received in a through bore provided in the drawer or cabinet. The socket 30 includes an integral enlarged head 32 arranged to abut the surface of the wall of the cabinet or drawer opposite that facing the roller 13, 14 to prevent the socket 30 passing completely through the through bore. The socket 30 includes an internally threaded shank 33 arranged to receive the threaded spindle of the roller 13, 14. As illustrated, teeth 34 are provided on the outer surface of the shank 33 in order to resist movement of the socket 30 in the bore.

The socket 31 illustrated in the lower part of the drawing is similar to that described above but omits the head 32, the socket 31 being intended for use in a blind bore. In order to reduce the risk of the socket 31 being pulled from the bore, adhesive or the like may be used to secure the socket 31 in the bore, but it will be noted that the intention is that introduction of the roller spindle into the socket 30 or 31 will expand the socket to cause it to bind in the bore in the cabinet or drawer.

Where screw threaded spindles 13*b*, 14*b* are used, the end of the spindle is conveniently provided with means for receiving a tool to aid rotation of the spindle. For example, the spindle may be provided with a hexagonal or other polygonal recess to receive an Allen (Registered Trade Mark) key or the like. Alternatively, a diametral slot or cruciform slot 35 may be provided to receive the blade of an appropriate screwdriver (see FIG. 11).

The spindle may comprise a single machined article. However, since the screw threaded part thereof (when present) is of substantially smaller diameter than the part defining the inner race of the bearing, machining is time consuming and wasteful of materials. As an alternative (see FIG. 11), the spindle may comprise a generally cylindrical inner race member 36, preferably a machined member, the outer circumference of which is provided with a groove for receiving the ball or needle bearings 37. The member 36 is provided with an axial through bore arranged to receive a screw or bolt 38, or a suitable deformable stud, the member 36 preferably including a countersink portion to receive the head of the screw 38. An annular spacer 39 is passed over the free end of the screw 38 and is staked to the screw 38 so as to secure the screw 38 to the member 36.

In an alternative arrangement, the machined member is provided with a small annular step or other registration means to enable an annular spacer to be positioned coaxially with the member. As with the FIG. 11 embodiment a screw or bolt of suitable length may then be used to secure the assembly of member and spacer in the desired location, or a metal stud for securing to the drawer or carcass may be passed through the bore of the member, and the end of the stud deformed into the countersink of the member to prevent removal of the member from the stud. As an alternative, or in addition, the end of the stud to be mounted on the drawer or cabinet could be mounted by deforming the end of the stud. It is also envisaged to construct the member and spacer as a single machined article (see FIG. 11*a*).

There may be instances where as in a filing cabinet the drawer and/or cabinet constructions are of plastics or metal, and the roller spindles are anchored thereto either directly or by brackets or fixing points welded to the drawer and cabinet construction. There may also be instances where the rollers are carried by brackets secured to the cabinets by screws, and in each of these instances the provision of the aperture 22 is of considerable importance since it affords access to fixing screws allowing the constructions to be assembled after completion of the cabinet.

FIG. 12 shows an embodiment in which the rollers 13 are rivetted to a bracket attached to a plastics or metal drawer of the type including a cover or skirt 50. The rollers 14 are mounted upon spindles which are welded to respective metal brackets 51. As described above, each spindle comprises a machined member 36 and a metal stud, an end of the stud being received within a countersink recess of the member 36 and being deformed to retain the member 36. The other end of the stud is rivetted or welded to the bracket 51, the bracket 51 being secured to, in this case, a wooden carcass by means of suitable screws 52.

A drawer slide 15 of the type described hereinbefore is operatively associated with the rollers 13, 14, permitting opening and closing of the drawer. As the cover 50 is present, when the drawer is open, the part of the drawer slide 15 which would otherwise be exposed is concealed behind the cover 50, thus the cover 50 reduces the risk of injury due to, for example, fingers becoming trapped in the drawer slide assembly, and in addition, the aesthetic appeal of the assembly is increased.

In the arrangement illustrated in British Patent 2130472 it is necessary to assemble the slides to the rollers 14 after the rollers 14 are secured to the inner wall of the cabinet, and before the rear wall of the cabinet is put in place. It will be recognized that the one open end of me channel which receives the rollers 14 is the end of the channel which must be adjacent the front of the cabinet in use, and thus if the rollers 14 are already in position on the cabinet wall then the slide must be introduced onto the rollers 14 from the rear end of the cabinet and this can only be effected prior to fitting the rear wall of the cabinet. Any fixings for the rollers 14 would be obscured by the web 19 thus preventing access to the fixings once the slide is engaged with the rollers. However, the provision of the aperture 22 in the web 19 allows the rollers 14 to be engaged with the slide prior to fixing of the rollers 14 to the cabinet. Thus the cabinet can be completed by affixing its rear wall before the slide and rollers 14 are affixed to the cabinet. The slide is then moved relative to the rollers to expose a roller fixing through the aperture 22 so that a tool may be employed to manipulate the roller fixing as necessary. It would be recognized also that the provision of the aperture 22 facilitates maintenance and replacement of components in use without disassembling the cabinet carcass. Furthermore, it will be recognized that the provision of an aperture 22 is not restricted to the form of slide illustrated in FIGS. 2 to 5 and is also applicable to the slide constructions illustrated in FIGS. 6 to 10 herein, and to the slide construction illustrated in British Patent 2130472.

If desired in addition to providing the aperture 22 in the drawer slide 15, one or more further apertures similar to the aperture 22 may be provided in positions spaced therefrom. The provision of such further aperture(s) is of particular importance where the drawer slide 15 is intended to be fitted to a cabinet of depth similar to the length of the drawer slide 15 and in which there is insufficient space to permit assembly of the rollers 14 and drawer slide 15 before fitting the drawer slide 15 to the cabinet. In order to ensure that the drawer can be removed the cut-out (23) is likely, to be spaced from the end of the slide by a distance not exceeding approximately 50 to 75 mm.

It will be recognized that in order to assemble the drawer rollers 13 into the upper tracks of the slide after the slide has been assembled to the rollers 14 of the cabinet, the slide is pulled forward so that it protrudes from the cabinet with the cut-out 23 uppermost and foremost. The drawer can then be engaged by introducing the rollers thereof through the cut-out 23 and into the tracks 16. It has been found that where the roller 13 closest to the cut-out 23 contacts the sharp edge of the top track 16*a* upon closing of the drawer, particularly when the drawer is subject to a heavy load damage to the periphery, of the roller 13 and increased wear thereof occurs. In order to reduce such damage and wear, the edge of the too track 16*a* defining an end of the cut-out 23 is preferably flared outwardly as shown in FIG. 3 in order to guide the roller 13 into the correct position with respect to the top track 16*a*.

The drawer slide illustrated in FIG. 3 may be modified by spacing the cut-out 23 from the front end of the drawer slide 15. Such a position of the cut-out 23 has the advantage that when the drawer is fully extended, the foremost roller 13 is supported by both the top and bottom tracks 16*a*, 16*b* forming the upper track 16 rather than by the bottom track 16*b* alone, the provision of the cut-out 23 still permitting removal of the drawer from the cabinet. In order to ensure that the drawer can be removed, the cut-out (23) is likely to be spaced from the end of the slide by a distance not exceeding approximately 50 to 75 min.

In normal use the flanges 24 and 25 are abutted by the rollers 13 to limit movement of the drawer relative to the slide 15 in both directions. Similarly, the rearmost roller 14 abuts the flange 26 to prevent the drawer and slides being pulled completely from the cabinet when opening the drawer, and abutment of the slide and/or the rear end of the drawer with the rear wall of the cabinet limits movement of the drawer in the closing direction. There may however be detachable and/or adjustable abutments on the inner wall of the cabinet to coact with the drawer and/or the slide 15 to limit inward movement of the drawer and slide where the cabinet is significantly deeper than the length of the drawer.

It has been found that in some circumstances, the flanges 24, 25, 26 are not of sufficient strength repeatedly to stop movement of the drawer without being permanently deformed. In order to minimise such deformation, the flanges 24, 25, 26 and the adjacent parts of the webs 18, 19 may be provided with reinforcements in the form of ribs 40. As shown in FIG. 4, the ribs 40 each extend along part of the respective wed 18, 19 around the intersection of the web 18, 19 and flange 24, 25, 26 and across the full width or part of the width of the flange 24, 25, 26. In the illustrated example, each flange is provided with a pair of such ribs 40 vertically spaced from one another. It will be recognized, however, that a single rib 40 or more than two ribs 40 could be provided. This enables thinner gauge material to be used whilst satisfying the requirements of BS4875 level 4 for full extension of the drawer.

In the case of the flange 24 adjacent the cut-out 23, since the track 16*a* may not be present (the track 16*a* performing a strengthening function where present) one or more of the reinforcing ribs 40 may be extended along the web in order to reinforce that part of the slide 15.

A comparison of the shaping of the slide 15 illustrated in FIGS. 2 to 5, with the slide illustrated in British Patent 2130472 reveals further significant differences over and above the provision of the aperture 22. Firstly the curved upper edge of the slide defining the track 16*a* does not incorporate an outwardly and upwardly turned portion terminating in a horizontal flange as shown at 21 in Patent 2130472. Surprisingly it has proved possible to dispense with such a structure without significantly reducing the rigidity of the structure. Furthermore, the formation of the track 17*b* of the lower edge of the slide involves forming a right angled flange and then bending the flange over to form a part circular rib in the present construction by comparison with forming the rib first and the flange second in the arrangement illustrated in Patent 2130472. Again there may be advantages arising from this difference most notably in the ease and convenience with which the slide can be produced by cold rolling.

Essentially a cold rolling process is a continuous process in which plain strip is converted into the slides 15. The apertures 22 could be provided by a rotary punch operating to produce holes at predetermined spacings along the strip being cold rolled. However, in order to provide the cut-out 23 and the flanges 24, 25 and 26 on a continuous basis moving tooling is needed and this tooling could also produce the apertures 22. Such tooling, moving in a forward pass at the same speed as the rolling speed, while actually performing the operations on the rolled strip, and then returning rapidly along the length of the strip before performing another operating pass, is possible, and can be used to form the cut-outs 23, and then to crop or guillotine the strip into lengths having lengthwise protrusions which, as a final operation, are bent at right angles to form the flanges 24, 25, 26. It is to be understood however that if desired a simple guillotine arrangement may be provided for cutting the cold rolled strip into predetermined lengths, and those predetermined lengths may then be fed to one or more presses or other machine tools for producing the cut-out 23, the aperture 22, and the flanges 24, 25, 26.

In use it is desirable that the flanges 24, 25, 26 carry rubber or moulded synthetic resin bumpers or buffers 42 (as shown in FIG. 3*a*) which coact with the rollers 13,14 and provide a sound deadening, and shock-absorbing function at the ends of the travel of the various components.

Suitable designs of synthetic resin bumper 42 are illustrated in FIG. 3*a*, 10*a* and 10*b*, and comprises a shock absorbing material of shore hardness falling in the range 40 to 50. The buffer 42 includes a concave face 43 presented towards the rollers 13, 14, in use the shape and choice of material minimizing bouncing of the rollers 13, 14 so that if the drawer is opened or closed forcefully, undesired movement of the drawer due to the rollers redounding is minimized. The shape of the buffers 42 is also such that part of the cut-out 23 is obscured when the cut-out 23 is provided adjacent an end of the slide 15, the introduction or removal of a roller 13 through the cut-out 23 requiring deformation of the buffer 42. It will thus be recognized that unintentional removal of the rollers 13 can be reduced.

The buffers 42 each include a slot 44 arranged to receive a respective one of the flanges 24, 25, 26. Where the flanges 24, 25, 26 are provided with strengthening ribs 40, the slot 44 provided in each buffer 42, and the sides of the buffers 42 are conveniently provided with grooves 45 arranged to receive the strengthening ribs 40, as shown in FIGS. 10*a* and 10*b*.

As mentioned previously, the length of the drawer slide is largely dependent upon the dimensions of the drawer and of the cabinet. It is therefore desirable to be able to provide a range of drawer slide sizes in order mat the drawer slides can be used in a variety of articles of furniture. It is therefore proposed to produce a range of drawer slides of different lengths. In order to further increase the range of articles of furniture with which the drawer slides are suitable for use, it is proposed to produce a range of buffers 42 of different sizes, the dimensions of the parts 46 of the buffers 42 falling outside of the channel being chosen so mat when the drawer is in its closed position, the buffer at one end of the drawer slide abuts the rear face of the drawer front, the buffers at the other end of the drawer slide abutting the inner face of the rear of the cabinet or where the drawers are significantly smaller man the cabinet, stops mounted on the cabinet. It will be recognized that by producing a range of drawer slides and a range of buffers, the drawer slides may be used in a large variety of articles of furniture.

Figure 6:
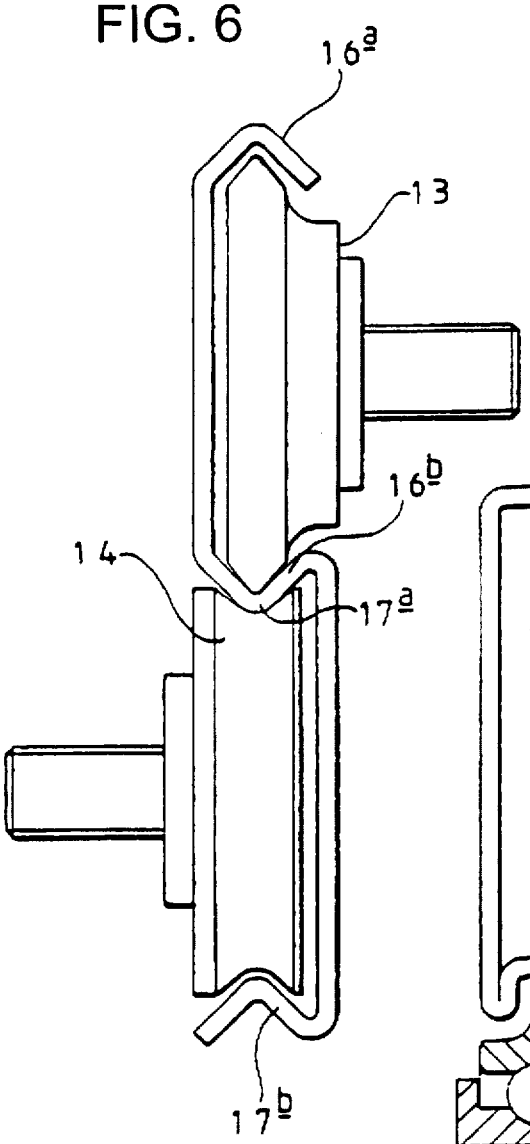

In the arrangement illustrated in FIG. 6 the smooth, part circular, curves of the tracks 16 and 17 are replaced by V-shapes, and the treads of the rollers 13, 14 are shaped correspondingly. The included angle of the treads of the rollers 13 will desirably be more acute than the included angle of the tracks 16 and the equivalent relationship will be true of the tracks 17 and the rollers 14 so that the faces of the rollers do not bind on the faces of the tracks during the rolling action.

Figure 7:
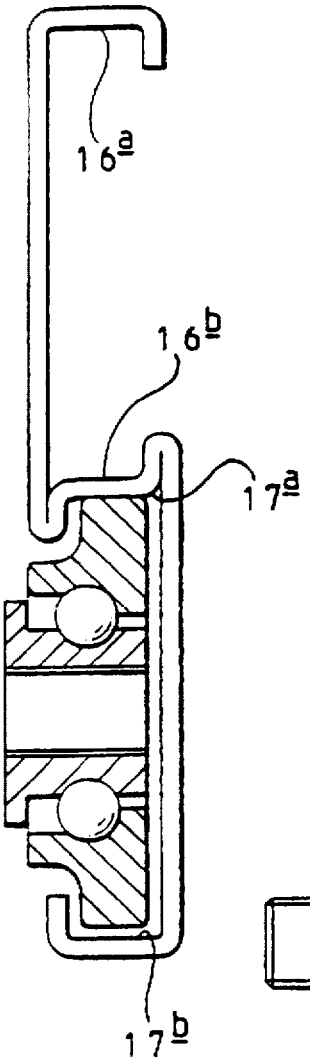

In FIG. 7 the tracks and rollers are plain, that is to say the rollers are cylindrical and the tracks are flat. It will be seen that the rolling operation has been simplified to the extent that there is no concavity whatsoever in the bottom track 16b of the upper two tracks but FIG. 8 shows a variation of FIG. 6 in which an additional rolling stage is incorporated to provide an upstanding rib at the outer face of the lower track 16b so that all four tracks are of channel cross-section.

FIG. 9 shows a further variation in the shape of the drawer slide profile. The drawer slide illustrated in FIG. 9 is similar to that of FIG. 2 with the exception that the lower edge of the web 19 includes a part 19a which is bent through approximately 180° to extend upwardly, bent upwardly to define a convex surface forming the lower track 17b which is a mirror image of the track 17a. The free edge of the strip is bent inwardly to form an inwardly extending generally horizontal flange 21, the flange 21 engaging with the part 19a of the strip which is bent through approximately 180°. This variation is similar to the drawer slide illustrated in GB 2130472 except that in the GB 2130472 drawer slide, the flange is spaced apart from the part of the strip which is bent through 180°. It has been found, however, that the production of such a profile is difficult, requiring more complex roll stands, and hence that the variation illustrated in FIG. 9 of the present application is preferred over that of GB 2130472.

FIGS. 6 to 9, although diagrammatic, illustrate clearly that the diameter of the effective portions of the treads of the rollers is preferably slightly less than the spacing between the effective portions of the corresponding tracks again to avoid any risk of rollers binding in their tracks. Desirably the material from which the rollers are formed will be chosen to exhibit self lubricating properties, for example hard nylon, PTFE or ACETAL.

It will be recognised that although FIG. 1 discloses the rollers 13 and the rollers 14 in pairs, additional rollers 13 and 14 may be incorporated if necessary to accept higher loadings.

As mentioned previously it is extremely convenient to be able to produce the slides 15 from mild steel strip by cold rolling. Additional advantages arise in that protective coatings can readily be provided on mild steel strip either before, or after rolling. For example, the slides could be rolled from strip which has been hot dipped galvanised. Alternatively, plain mild steel slides 15 may be electrophoretically coated after their formation, or could be provided by spraying or dipping with paint or powder coatings.

I claim:

1. A drawer slide formed by cold rolling metal strip and shaped, in cross-section, to define first mutually presented tracks for receiving and cooperating with a first set of rollers carried by a drawer, second mutually presented tracks for receiving and cooperating with rollers carried by a drawer receiving cabinet, a first web portion integrally interconnecting the first tracks, a second web portion integrally interconnecting the second tracks, integral stop means closing both ends respectively of a first channel defined by one of the first and second web portions and its respective tracks, integral stop means closing an end of a second channel defined by the other of said first and second web portions and the respective tracks and a cut-out provided in an outer track of the first channel to facilitate insertion of the respective rollers into said first channel, and an access aperture provided in the others of the first and second web portion of said second channel providing access through said other of said first and second web portion to means for securing the respective rollers to the drawer or to the cabinet.

2. A drawer slide as claimed in claim 1, wherein the cut-out is provided adjacent an end of the drawer slide, the integral stop means of the second channel being provided at the end thereof remote from the cut-out.

3. A drawer slide as claimed in claim 2, further comprising buffer means associated with the integral stop means adjacent the cut-out.

4. A drawer slide as claimed in claim 3, wherein the buffer means associated with the stop means adjacent the cut-out comprises a shock absorbent resilient member arranged to partially close the cut-out, in, to restrict removal of at least one of the rollers from the first channel.

5. A drawer slide as claimed in claim 1, wherein the cut-out is spaced from an end of the slide.

6. A drawer slide as claimed in claim 1, further comprising buffer means associated with at least one of the integral stop means of the first and second channels.

7. A drawer slide as claimed in claim 1, wherein each of the first and second tracks is of part circular cross-section.

8. A drawer slide as claimed in claim 1, wherein each of the first and second tracks is of generally 'V'-shaped cross-section.

9. A drawer slide as claimed in claim 1, wherein each of the first and second tracks is substantially flat.

10. A drawer side as claimed in claim 9, wherein at least one of the first and second tracks forms part of a respective channel-shaped portion of the drawer slide.

11. A drawer slide as claimed in claim 1, wherein a lower most one of the tracks, in use, is provided with an integral generally horizontally extending strengthening portion.

12. A drawer slide as claimed in claim 11, wherein the strengthening portion is provided between said track and the respective web portion.

13. A drawer slide as claimed in claim 11, wherein the strengthening portion is provided at the edge of said track remote from the respective web portion, a free edge of the strengthening portion is integral with the web portion.

14. A drawer slide as claimed in claim 1, further comprising reinforcement means for reinforcing the integral stop means.

15. A drawer slide assembly comprising a drawer slide formed by cold rolling metal strip and shaped, in cross-section, to define first mutually presented tracks for receiving and cooperating with a first set of rollers carried by a drawer, second mutually presented tracks for receiving and cooperating with rollers carried by a drawer receiving cabinet, a first web portion integrally interconnecting the first tracks, a second web portion integrally interconnecting the second tracks, integral stop means closing both ends respectively of a first channel defined by one of the first and second web portions and its respective tracks, integral stop means closing an end of a second channel defined by the other of said first and second web portions and the respective tracks and a cut-out provided in an outer track of the first channel to facilitate insertion of the respective rollers into said first channel, and an access aperture provided in the other of the first and second web portions of said second channel providing access through said other of said first and second web portions to means for securing the respective rollers to the drawer or to the cabinet, and rollers arranged to be received in and to cooperate with the first and second tracks, wherein each roller comprises a spindle upon which a roller body is rotatably mounted.

16. A drawer slide assembly as claimed in claim 15, wherein at least one of the spindles comprises a member arranged to receive the roller body, a spacer element, and elongate attachment means.

17. A drawer slide assembly as claimed in claim 16, wherein the member and the spacer element are integral with one another.

18. A drawer slide assembly as claimed in claim 16, wherein the attachment means is integral with the member.

19. A drawer slide assembly as claimed in claim 16, wherein the attachment means extends within a bore provided in the member.

20. A drawer slide assembly as claimed in claim 16, wherein the attachment means comprises a screw-threaded rod arranged to be mounted upon one of the drawer and cabinet.

21. A drawer slide assembly as claimed in claim 20, wherein the screw-threaded rod is arranged to engage a socket mounted on the drawer or cabinet.

22. A drawer slide assembly as claimed in claim 20, wherein the screw-threaded rod is provided with means for receiving a tool to aid rotation thereof.

23. A drawer slide assembly as claimed in claim 16, wherein the attachment means includes a region intended to be deformed to prevent removal of the roller body from one of the drawer and the cabinet.

24. A drawer slide assembly as claimed in claim 15, further comprising a bracket arranged to be mounted upon at least one of the drawer and the cabinet, at least one roller being arranged to be mounted upon the bracket.

25. A drawer slide assembly as claimed in claim 15, further comprising a cover restricting access to the drawer slide and rollers.

26. An article of furniture comprising a cabinet and a drawer, the drawer being mounted to the cabinet by means of a drawer slide assembly formed by cold rolling metal strip and shaped, in cross-section, to define first mutually presented tracks for receiving and cooperating with a first set of rollers carried by a drawer, second mutually presented tracks for receiving and cooperating with rollers carried by a drawer receiving cabinet, a first web portion integrally interconnecting the first tracks, a second web portion integrally interconnecting the second tracks, integral stop means closing both ends respectively of a first channel defined by one of the first and second web portions and its respective tracks, integral stop means closing an end of a second channel defined by the other of said first and second web portions and the respective tracks and a cut-out provided in an outer track of the first channel to facilitate insertion of the respective rollers into said first channel, and an access aperture provided in the other of the first and second web portions of said second channel providing access through said other of said first and second web portion to means for securing the respective rollers to the drawer or to the cabinet, and rollers arranged to be received in and to cooperate with the first and second tracks, wherein each roller comprises a spindle upon which a roller body is rotatably mounted.

* * * * *